US007214718B1

(12) United States Patent
Ohtawa et al.

(10) Patent No.: US 7,214,718 B1
(45) Date of Patent: May 8, 2007

(54) QUATERNARY AMMONIUM SALT COMPOSITION

(75) Inventors: Yasuki Ohtawa, Wakayama (JP); Tohru Katoh, Wakayama (JP); Takeshi Tomifuji, Wakayama (JP)

(73) Assignee: Kao Corporation, Tokyo (JP)

( * ) Notice: Subject to any disclaimer, the term of this patent is extended or adjusted under 35 U.S.C. 154(b) by 258 days.

(21) Appl. No.: 10/111,977

(22) PCT Filed: Oct. 27, 2000

(86) PCT No.: PCT/JP00/07580

§ 371 (c)(1),
(2), (4) Date: Apr. 30, 2002

(87) PCT Pub. No.: WO01/32813

PCT Pub. Date: May 10, 2001

(30) Foreign Application Priority Data

Nov. 1, 1999 (JP) ..... 11-311070

(51) Int. Cl.
*B01F 17/18* (2006.01)
*C11D 1/46* (2006.01)
*C11D 1/645* (2006.01)

(52) U.S. Cl. ..... 516/203; 510/123; 510/138; 510/329; 510/330; 510/515; 252/8.61; 252/8.62; 252/8.81; 252/8.83

(58) Field of Classification Search ..... 516/203; 510/123, 138, 329, 330, 515; 252/8.61, 8.62, 252/8.81, 8.83
See application file for complete search history.

(56) References Cited

U.S. PATENT DOCUMENTS 5,939,059 A * 8/1999 Franklin et al. ..... 424/70.19
6,652,766 B1 * 11/2003 Frankenbach et al. ..... 252/8.91

FOREIGN PATENT DOCUMENTS

EP 675941 12/1993
EP 0 707 059 A2 * 4/1996
WO 94 04641 3/1994
WO 97 42279 11/1997
WO WO 99/27050 * 6/1999
WO 00 06678 2/2000

* cited by examiner

*Primary Examiner*—Daniel S. Metzmaier
(74) *Attorney, Agent, or Firm*—Oblon, Spivak, McClelland, Maier & Neustadt, P.C.

(57) ABSTRACT

The present invention provides a softening base and a softener having biodegradability employing a quaternary ammonium salt composition comprising (M) a monoester quaternary salt represented by the formula (I), (D) a diester quaternary salt represented by the formula (II) and (T) a triester quaternary salt represented by the formula (III), wherein the amount of (M) is 15 to 85% by weight, the amount of (D) is 0 to 44% by weight and the amount of (T) is 15 to 85% by weight based on the total amounts of (M), (D) and (T). The present invention also provides a process for producing the softener base and composition.

(I)

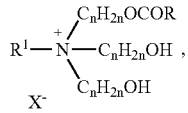

(II)

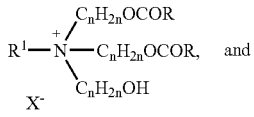

and (III)

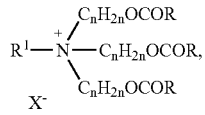

wherein R, $R^1$, n and $X^-$ are defined herein.

10 Claims, No Drawings

QUATERNARY AMMONIUM SALT COMPOSITION

TECHNICAL FIELD

The present invention relates to a quaternary ammonium salt composition, a process for producing the same and a softener composition containing the same.

BACKGROUND ART

Most of the commercially available merchandise as a softener composition for fibers are compositions comprising a quaternary ammonium salt containing two long-chain alkyl groups in one molecule and being typified by a di(long-chain alkyl) dimethyl ammonium chloride. However, the quaternary ammonium salt suffers from the problem that, when residues thereof after treatment is discharged into the environment such as a river, most of them are accumulated without biodegradation.

As improved products against this problem, N-methyl-N, N-bis(long-chain alkanoyl oxyethyl)-N-(2-hydroxyethyl) ammonium methyl sulfate etc. are commercially available. The product is produced by esterification of triethanolamine with a long-chain fatty acid and then quaternizing with dimethyl sulfate. The reaction molar ratio of the fatty acid to triethanolamine is usually from 1.8 to 2.1, and, at the same time, the ratio of the amount of the diester quaternary salt to the total amounts of the monoester, diester and triester quaternary salts is from 43 to 47% by weight. It has been considered that the reaction molar ratio was made in the range of 1.8 to 2.1 because the proportion of the diester quaternary salt is maximized in this range, while the proportion of the diester quaternary salt is reduced when the reaction molar ratio is less than 1.8 or more than 2.1, so that a softening performance is reduced. However, even if the reaction molar ratio is in the range of 1.8 to 2.1, a softening effect cannot be sufficiently satisfied.

As means to solve this problem, WO97/42279 discloses a quaternary ammonium salt wherein the amount of diester quaternary salt is greater than 55% by weight, as well as it also discloses a process for producing the same. This material has improved a softening performance but is still not satisfactory. Then, WO97/42279, U.S. Pat. No. 5,916,863, U.S. Pat. No. 6,004,913 and U.S. Pat. No. 6,037,315 disclose a textile softening composition which comprises a quaternary ammonium salt which comprises a mixture of mono-, di- and tri- ester components, wherein the amount of the diester quaternary is greater than about 55% by weight. The textile softening composition may have a solvent such as water.

EP-A 675941 discloses dispersions containing a quaternary ammonium compounds which are derived from triethanolamine and which contain one, two or three fatty acyloxyethyl groups, characterized in that the percentage content of compounds containing two fatty acid acyloxyethyl groups is greater than 50 mole-%, based on the total quantity of quaternary ammonium compounds.

DISCLOSURE OF INVENTION

The object of the present invention is to provide a softening base and a softener which are further excellent in a softening effect and biodegradability.

The present invention relates to a quaternary ammonium salt composition which comprises the following components (M), (D) and (T), wherein the amount of (M) is 15 to 85% by weight, the amount of (D) is 0 to 44% by weight and the amount of (T) is 15 to 85% by weight based on the total amounts of (M), (D) and (T). The present invention also relates to a process for producing the same and a softener composition comprising the quaternary ammonium salt composition.

(M) a monoester quaternary salt represented by the formula (I):

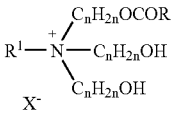

(I)

wherein R represents a $C_{5-35}$ alkyl or alkenyl group, $R^1$ represents a $C_{1-4}$ alkyl or hydroxyalkyl group, n is a number selected from 2 to 4 and $X^-$ is an anionic group;

(D) a diester quaternary salt represented by the formula (II):

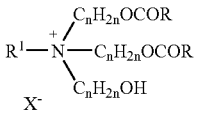

(II)

wherein each of R, $R^1$, n and $X^-$ has the same meaning as defined above; and (T) a triester quaternary salt represented by the formula (III):

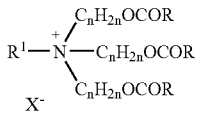

(III)

wherein each of R, $R^1$, n and $X^-$ has the same meaning as defined above.

Further, the present invention provides use of the above-mentioned composition as a softener for fibers and a method of softening fibers with the above-mentioned composition.

MODES FOR CARRYING OUT THE INVENTION

From the viewpoint of obtaining a sufficient softening effect, the amounts of components (M), (D) and (T) in the composition of the present invention are selected such that the amount of (M) is 15 to 85% by weight, preferably 20 to 84% by weight, more preferably 20 to 79% by weight, the amount of (D) is 0 to 44% by weight, preferably 1 to 44% by weight, more preferably 1 to 40% by weight, and the amount of (T) is 15 to 85% by weight, preferably 15 to 80% by weight, more preferably 20 to 60% by weight, based on the total amounts of (M), (D) and (T).

In the formulae (I), (II) and (III), the number of carbons in R is preferably from 11 to 23. $R^1$ is preferably a methyl or ethyl group. n is preferably 2. $X^-$ is preferably a halogen ion such as chloride ion or an alkyl sulfate ion such as methyl sulfate ion and ethyl sulfate ion.

In the process for producing the quaternary compound by reacting a trialkanolamine with a fatty acid to obtain a trialkanolamine ester and then quaternizing the trialkanolamine ester, the ratio of the monoesterified product is reduced while the ratio of the triesterified product is increased in proportion as the reaction molar ratio of the fatty acid to the trialkanolamine is increased, in general. When triethanolamine and a tallow fatty acid are used, the monoester quaternary salt as a major component is 40% by weight or more while the triester quaternary salt is less than 15% by weight in quaternary salts of the esterified products, if the molar ratio of the fatty acid to the triethanolamine is less than 1.3. Further, if the molar ratio is from 1.3 to 2.0, the diester quaternary salt in an amount of 45 to 48% by weight is produced as a main component. Furthermore, if the molar ratio is more than 2.0, the triester quaternary salt in an amount of 40% by weight or more is produced as a main component, while the monoester quaternary salt is less than 15% by weight. That is, the quaternary ammonium salt composition of the present invention is hardly obtained in a usual method by merely reaction of triethanolamine and a fatty acid and then quaternization.

Although the method of obtaining the quaternary ammonium salt composition of the present invention is not limited in particular, there is a method in which two or more alkanolamine-esterified products having different degrees of esterification are mixed and then quaternized or in which two or more quaternary salts of alkanolamine-esterified products having different degrees of esterification are mixed. Specifically, it is more than enough to mix a quaternary ammonium salt produced under such a condition that a reaction molar ratio of a fatty acid to trialkanolamine is low and another quaternary ammonium salt produced under such a condition that another reaction molar ratio thereof is high. The reaction molar ratio and the mixing (or blending) ratio thereof may be selected such that the ratios of the components (M), (D) and (T) are in the above-mentioned range, and three or more quaternary ammonium salts may be mixed. The alkanolamine-esterified products may be first mixed and then quaternized.

According to the present invention, the quaternary ammonium salt produced under such a condition that the reaction molar ratio of the fatty acid to trialkanolamine is low and the quaternary ammonium salt produced under such a condition that the reaction molar ratio thereof is high are produced in the same manner as for N-methyl-N,N-bis (long-chain alkanoyloxyethyl)-N-(2-hydroxyethyl) ammonium, methyl sulfate etc. That is, the salt can be produced by esterifying a trialkanolamine such as triethanolamine with a long-chain fatty acid such as a tallow fatty acid, a hydrogenated tallow fatty acid, stearic acid from a palm and hydrogenated (or hardened) stearic acid from a palm and a mixture of two or more members selected therefrom, with a lower alkyl ester thereof or with a fat and/or oil and then quaternizing the resultant ester with a quaternizing agent such as dimethyl sulfate, diethyl sulfate and methyl chloride.

In this case, a quaternized product of an unreacted trialkanolamine is formed when the reaction molar ratio of the fatty acid to the trialkanolamine is lower, but it is no matter that the quaternized product of the amine unreacted in the esterification reaction is present. Further, the unreacted fatty acid remains when the reaction molar ratio is high, but it is no matter that the fatty acid is present.

If two or more alkanolamine-esterified products having different degrees of esterification are mixed or if two or more quaternized products thereof having different degrees of esterification are mixed, the fatty acid residues thereof may be the same or different. From the viewpoint of a softening performance, the fatty acid residue of a compound having high degree of esterification is preferably a residue derived from a tallow fatty acid or stearic acid from a palm. On the other hand, the fatty acid residue of a compound having low degrees of esterification is preferably a hydrogenated tallow fatty acid residue from the viewpoint of a softening performance.

The quaternary ammonium salt composition of the present invention can be formed into a liquid softener by dispersing 3 to 50% by weight of the said composition in water.

A nonionic surfactant is preferably blended with the softener composition of the present invention in order to improve a dispersibility and softening effect. The nonionic surfactant for use is preferably an alkylene oxide adduct of a higher alcohol, more preferably an adduct of ethylene oxide with 5 to 100 moles, particularly 10 to 60 moles, to a higher alcohol having 8 to 22 carbon atoms.

A higher alcohol or higher fatty acid can be added in order to further improve a softening performance. A lower alcohol such as ethanol and isopropanol, glycol or polyol as well as an ethylene oxide or propylene oxide adduct thereof can be added as a storage stabilizer. Furthermore, an inorganic salt, a pH adjuster, a hydrotropic agent, a perfume, a defoaming agent, a pigment and the like can be added if necessary.

[Method of Analyzing the Ester Quaternary Salt]

The composition of the monoester, diester and triester quaternary salt according to the present invention is determined in the following manner.

An ester amine obtained from triethanolamine with a fatty acid is dissolved in $CDCl_3$ and analyzed with a nuclear magnetic resonance spectrum (NMR, with an internal standard TMS). The ratio by weight of the quaternary salts was calculated on the basis of the other ratio determined by integration concerning a peak of a methylene group (—$CH_2$—OH—) adjacent to a hydroxyl group observed at about 3.5 to 3.7 ppm and another peak of another methylene group (—OCO—$CH_2$—) adjacent to an ester group observed at about 4.0 to 4.2 ppm, in order to prepare the ratio by composition.

EXAMPLES

Examples 1 to 17 and Comparative Examples 1 to 10

Triethanolamine was reacted with a hydrogenated tallow fatty acid or tallow fatty acid in each of the molar ratio shown in Table 1 and then quaternized with dimethyl sulfate to obtain Compounds A-1 to A-7 and B-1 to B-2 having the compositions shown in Table 1.

The composition (% by weight) in Table 1 is calculated as a weight value in the quaternary salt based on the other composition obtained by measuring with a nuclear magnetic resonance spectrum (NMR, in $CDCl_3$ solvent, with an internal standard TMS) of the ester amine.

The compounds A-1 to A-7 and B-1 to B-2 were used singly respectively or mixed in the weight ratios shown in Tables 2 and 3 to obtain the quaternary ammonium salt composition having the compositions shown in Tables 2 and 3.

Next, 5% by weight of composition were added dropwise to water at 60° C. in which 5% by weight of an adduct of ethylene oxide with 20 moles to lauryl alcohol were dissolved in order to prepare each of softeners. The softener was evaluated for a softening effect in the following manner. The results are shown in Table 4.

<Method of Evaluating a Softening Effect>

① Softening Treatment 1 kg of commercial cotton towels or jersey cloths made of acrylate fibers was laundered repeatedly 5 times with a commercial detergent "Attack" (a registered trade mark, manufactured by Kao Corporation) in hard water of 3.5° DH in a laundering machine having its capacity of 15 L. Then, 25 ml of the softener was introduced thereinto and the resultant was treated at 25° C. for 1 minute under stirring ② Evaluation for a Softening Effect The cloth thus subjected to softening treatment was air-dried at room temperature and then left in a constant temperature and humidity chamber at 25° C. under 65% RH for 24 hours. The cloth with the softener of Comparative Example 8 was used as the control and 10 skilled testers evaluated by the paired comparison test with the following criteria. The average value of the evaluations by 10 tester was rounded off as follows, namely, the fraction thereof of 0.5 or more was counted as a unit and the rest was cut away. The rounded value was made as the evaluation value.

+2: Softer than the control.

+1: Somewhat softer than the control.

0: Equal in softening effect to the control.

−1: Somewhat harder than the control.

−2: Harder than the control.

TABLE 1

| Compound | Molar Ratio*1 | Fatty acid | Composition (% by weight) Monoester quaternary salt*3 | Diester quaternary salt*3 | Triester quaternary salt*3 | Quaternary salt of triethanol amine |
|---|---|---|---|---|---|---|
| A-1 | 0.7 | Hydrogenated | 48 | 22 | 3 | 27 |
| A-2 | 0.9 | tallow fatty | 46 | 29 | 6 | 19 |
| A-3 | 1.3 | acid | 37 | 41 | 14 | 8 |
| A-4 | 2.0 | | 15 | 44 | 39 | 2 |
| A-5 | 2.5 | | 4 | 30 | 66 | 0 |
| A-6 | 2.9 | | 0 | 7 | 93 | 0 |
| A-7 | 2.9 | Tallow | 0 | 7 | 93 | 0 |
| B-1 | 2.0 | fatty | 15 | 44 | 39 | 2 |
| B-2*2 | 0.9 | acid | 27 | 60 | 13 | 0 |

*1Molar ratio of fatty acid to triethanolamine.
*2Produced by esterifying triethanolamine with tallow fatty acid, then subjecting it to thin-film distillation, distilling the unreacted triethanolamine and monoesterified product off, and moreover quaternizing the resultant product.
*3% by weight including also the quaternary salt of triethanolamine.

TABLE 2

| Examples | Blending ratio by weight | Quaternary ammonium salt composition (% by weight) Monoester quaternary salt* | Diester quaternary salt* | Triester quaternary salt* | Quaternary salt of triethanol amine* |
|---|---|---|---|---|---|
| 1 | A-1/A-6 = 4/1 | 49 (38) | 24 (19) | 27 (21) | (22) |
| 2 | A-1/A-6 = 3/2 | 34 (29) | 19 (16) | 47 (39) | (16) |
| 3 | A-1/A-6 = 2/3 | 21 (19) | 15 (13) | 64 (57) | (11) |

TABLE 2-continued

| Examples | Blending ratio by weight | Quaternary ammonium salt composition (% by weight) Monoester quaternary salt* | Diester quaternary salt* | Triester quaternary salt* | Quaternary salt of triethanol amine* |
|---|---|---|---|---|---|
| 4 | A-2/A-6 = 4/1 | 43 (37) | 29 (25) | 28 (23) | (15) |
| 5 | A-2/A-6 = 3/2 | 31 (28) | 23 (20) | 46 (41) | (11) |
| 6 | A-2/A-6 = 2/3 | 20 (18) | 17 (16) | 63 (58) | (8) |
| 7 | A-3/A-6 = 4/1 | 32 (30) | 36 (34) | 32 (30) | (6) |
| 8 | A-3/A-6 = 3/2 | 23 (22) | 29 (27) | 48 (46) | (5) |
| 9 | A-3/A-6 = 2.5/2.5 | 19 (19) | 25 (24) | 56 (54) | (3) |
| 10 | A-1/A-5 = 2.5/2.5 | 30 (26) | 30 (26) | 40 (35) | (13) |
| 11 | A-2/A-5 = 3/2 | 33 (29) | 33 (29) | 34 (30) | (12) |
| 12 | A-3/A-5 = 3.5/1.5 | 29 (27) | 40 (38) | 31 (30) | (5) |
| 13 | A-1/A-4 = 3/2 | 42 (35) | 37 (31) | 21 (17) | (17) |
| 14 | A-2/A-4 = 3.5/1.5 | 43 (37) | 39 (34) | 18 (16) | (13) |
| 15 | A-3/A-4 = 2.5/2.5 | 27 (26) | 44 (43) | 28 (27) | (4) |

TABLE 2-continued

| Examples | Blending ratio by weight | Quaternary ammonium salt composition (% by weight) Monoester quaternary salt* | Diester quaternary salt* | Triester quaternary salt* | Quaternary salt of triethanol amine* |
|---|---|---|---|---|---|
| 16 | A-1/A-7 = 3/2 | 34 (29) | 19 (16) | 47 (39) | (16) |
| 17 | A-2/A-7 = 3/2 | 31 (28) | 22 (20) | 47 (41) | (11) |

TABLE 3

| Comparative Examples | Blending ratio by weight | Quaternary ammonium salt composition (% by weight) | | | |
|---|---|---|---|---|---|
| | | Monoester quaternary salt* | Diester quaternary salt* | Triester quaternary salt* | Quaternary salt of triethanol amine* |
| 1 | A-1 | 66 (48) | 30 (22) | 4 (3) | (27) |
| 2 | A-2 | 57 (46) | 36 (29) | 7 (6) | (19) |
| 3 | A-3 | 40 (37) | 45 (41) | 15 (14) | (8) |
| 4 | A-4 | 15 (15) | 45 (44) | 40 (39) | (2) |
| 5 | A-5 | 4 (4) | 30 (30) | 66 (66) | (0) |
| 6 | A-6 | 0 (0) | 7 (7) | 93 (93) | (0) |
| 7 | A-7 | 0 (0) | 7 (7) | 93 (93) | (0) |
| 8 | B-1 | 15 (15) | 45 (44) | 40 (39) | (2) |
| 9 | A-4/A-6 = 4/1 | 12 (12) | 37 (37) | 51 (50) | (1) |
| 10 | B-2 | 27 | 60 | 13 | 0 |

*: % by weight to the total of monoester, diester and triester quaternary salts, and % by weight in the bracket including also the quaternary salt of triethanolamine.

TABLE 4

| | | Results of evaluations for softening effect | |
|---|---|---|---|
| | | Cotton towels | Jersey cloths made of acrylate fibers |
| Examples | 1 | +2 | +1 |
| | 2 | +2 | +1 |
| | 3 | +1 | +2 |
| | 4 | +2 | +1 |
| | 5 | +2 | +1 |
| | 6 | +1 | +2 |
| | 7 | +2 | +1 |
| | 8 | +2 | +1 |
| | 9 | +1 | +1 |
| | 10 | +2 | +1 |
| | 11 | +2 | +1 |
| | 12 | +2 | +1 |
| | 13 | +1 | +1 |
| | 14 | +1 | +1 |
| | 15 | +1 | +1 |
| | 16 | +2 | +2 |
| | 17 | +2 | +2 |
| Comparative Examples | 1 | −1 | 0 |
| | 2 | 0 | 0 |
| | 3 | 0 | 0 |
| | 4 | 0 | −1 |
| | 5 | −1 | −2 |
| | 6 | −2 | −2 |
| | 7 | −2 | −2 |
| | 8 | 0 | 0 |
| | 9 | −1 | −1 |
| | 10 | +1 | 0 |

The invention claimed is:

1. A quaternary ammonium salt composition which comprises the following components (M), (D) and (T), wherein the amount of (M) is 15 to 85% by weight, the amount of (D) is 0 to 44% by weight and the amount of (T) is 15 to 85% by weight based on the total amounts of (M), (D) and (T):

(M) a monoester quaternary salt represented by the formula (I):

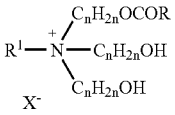

(I)

wherein R represents a $C_{5-35}$ alkyl or alkenyl group, $R^1$ represents a $C_{1-4}$ alkyl or hydroxyalkyl group, n is a number selected from 2 to 4 and $X^-$ is an anionic group;

(D) a diester quaternary salt represented by the formula (II):

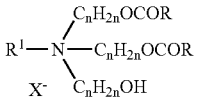

(II)

wherein each of R, $R^1$, n and $X^-$ has the same meaning as defined above; and (T) a triester quaternary salt represented by the formula (III):

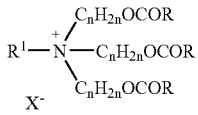

(III)

wherein each of R, $R^1$, n and $X^-$ has the same meaning as defined above.

2. A process for producing the quaternary ammonium salt composition as defined in claim 1, wherein two or more alkanolamine-esterified products having different degrees of esterification are mixed and then quaternized or wherein two or more quaternary salts of alkanolamine-esterified products having different degrees of esterification are mixed.

3. The composition as claimed in claim 1, wherein the amount of (D) is 1 to 44% by weight.

4. The composition as claimed in claim 1, wherein the amount of (M) is 20 to 79% by weight, the amount of (D) is 1 to 40% by weight and the amount of (T) is 20 to 60% by weight.

5. The quaternary ammonium salt composition of claim 1, wherein the number of carbons in R is 11 to 23.

6. The quaternary ammonium salt composition of claim 1, wherein $R^1$ is at least one member selected from the group consisting of methyl and ethyl.

7. A softener composition comprising the quaternary ammonium salt composition as defined in claim 1.

8. The softener composition of claim 7, wherein said composition comprises 3 to 50 wt. % of said quaternary ammonium salt composition.

9. The softener composition of claim 7, further comprising a higher alcohol or higher fatty acid.

10. The softener composition of claim 7, further comprising a storage stabilizer.

* * * * *